US008134833B2

(12) United States Patent
Agostini et al.

(10) Patent No.: US 8,134,833 B2
(45) Date of Patent: Mar. 13, 2012

(54) EVAPORATOR FOR A COOLING CIRCUIT

(75) Inventors: Bruno Agostini, Dietikon (CH); Berk Yesin, Zurich (CH)

(73) Assignee: ABB Research Ltd, Zurich (CH)

( * ) Notice: Subject to any disclaimer, the term of this patent is extended or adjusted under 35 U.S.C. 154(b) by 0 days.

(21) Appl. No.: 12/465,442

(22) Filed: May 13, 2009

(65) Prior Publication Data

US 2009/0284925 A1 Nov. 19, 2009

(30) Foreign Application Priority Data

May 14, 2008 (EP) ..... 08156175

(51) Int. Cl.
*H05K 7/20* (2006.01)

(52) U.S. Cl. .. 361/700; 361/699; 165/80.4; 165/104.33; 174/15.1; 174/15.2

(58) Field of Classification Search ..... None
See application file for complete search history.

(56) References Cited

U.S. PATENT DOCUMENTS

| | | | | |
|---|---|---|---|---|
| 4,546,608 | A | 10/1985 | Shiina et al. | |
| 4,949,164 | A * | 8/1990 | Ohashi et al. | 257/715 |
| 5,021,924 | A * | 6/1991 | Kieda et al. | 361/699 |
| 5,195,577 | A | 3/1993 | Kameda et al. | |
| 5,859,763 | A * | 1/1999 | Nam et al. | 361/699 |
| 5,871,043 | A * | 2/1999 | Osakabe et al. | 165/104.21 |
| 5,998,863 | A * | 12/1999 | Kobayashi et al. | 257/715 |
| 6,005,772 | A * | 12/1999 | Terao et al. | 361/699 |
| 6,527,045 | B1 * | 3/2003 | Osakabe et al. | 165/104.33 |
| 6,561,262 | B1 * | 5/2003 | Osakabe et al. | 165/104.21 |
| 6,681,843 | B2 * | 1/2004 | Sugito | 165/104.33 |
| 6,820,684 | B1 * | 11/2004 | Chu et al. | 165/104.33 |
| 6,992,382 | B2 * | 1/2006 | Chrysler et al. | 257/717 |
| 7,011,146 | B2 * | 3/2006 | Wong | 165/104.33 |
| 7,017,657 | B2 * | 3/2006 | Sugito et al. | 165/104.21 |
| 7,077,189 | B1 * | 7/2006 | Reyzin et al. | 165/80.4 |
| 7,134,289 | B2 * | 11/2006 | Patel et al. | 62/121 |
| 7,201,215 | B2 * | 4/2007 | Ippoushi et al. | 165/104.24 |
| 7,435,623 | B2 * | 10/2008 | Chrysler et al. | 438/122 |
| 2008/0179044 | A1 * | 7/2008 | Hu et al. | 165/80.4 |
| 2009/0242174 | A1 * | 10/2009 | McCutchen et al. | 165/104.25 |
| 2010/0012299 | A1 * | 1/2010 | Sakamoto et al. | 165/104.21 |

FOREIGN PATENT DOCUMENTS

| | | | |
|---|---|---|---|
| EP | 0 398 805 | A1 | 11/1990 |
| GB | 2 225 099 | A | 5/1990 |
| JP | 59-094445 | A | 5/1984 |
| JP | 5-118777 | A | 5/1993 |
| JP | 5-288484 | A | 11/1993 |
| JP | 2002-122392 | A | 4/2002 |

OTHER PUBLICATIONS

European Search Report dated Oct. 31, 2008.

* cited by examiner

*Primary Examiner* — Boris Chervinsky
(74) *Attorney, Agent, or Firm* — Buchanan Ingersoll & Rooney PC

(57) ABSTRACT

An evaporator is disclosed for a cooling circuit. The evaporator includes a housing having at least one wall for contacting a heat emitting device. A channel, the cross section of which is small enough to allow convection boiling, and a separation volume are located in the evaporator. The separation volume is located at a vapor exiting port of the channel. The evaporator can include a liquid reservoir.

17 Claims, 3 Drawing Sheets

EVAPORATOR FOR A COOLING CIRCUIT

RELATED APPLICATION

This application claims priority under 35 U.S.C. §119 to European Patent Application No. 08156175.5 filed in Europe on May 14, 2008, the entire content of which is hereby incorporated by reference in its entirety.

TECHNICAL FIELD

A cooling circuit is disclosed, such as a two-phase cooling circuit, for cooling at least one of a power electronic and a power electric device, and/or a power module comprising such a cooling circuit.

BACKGROUND INFORMATION

As power electronic devices reach larger and larger power values and consequently emit more heat, efficient cooling of such power electronic devices becomes more and more important. One way of providing an efficient cooling system for such power electronic devices, for example semi-conductor switching elements or the like, is to provide a two-phase cooling circuit. Such a cooling circuit brings a liquid into thermal contact with the device emitting heat. The liquid is heated by the emitted heat and reaches a boiling temperature. As the temperature of the liquid itself will not rise above the boiling temperature the temperature of the liquid and therefore the temperature of the electronic device is kept at a temperature of the boiling point of the liquid as a maximum.

For example, the liquid can be stored in a reservoir inside the evaporator. The evaporator is in thermal contact with the heat emitting device. The vapor of the liquid is then converged through a conduit to a condenser. Within the condenser the vapor is changed into liquid by rejecting heat at constant temperature to a coolant fluid, air at ambient temperature for example. The vapor thus returns to its liquid phase. The condenser and the evaporator are connected via a second line in order to feed back the condensed vapor as liquid again to the liquid reservoir of the evaporator.

Such a cooling device is disclosed in U.S. Pat. No. 5,195,577. With such a cooling circuit, the evaporator provides the function of a liquid reservoir. Thus, the cross section of such an evaporator is relatively large. Consequently the efficiency of the evaporator can be relatively low. This is because of the introduced heat leads to boiling of the liquid which is provided in a large volume of the evaporator. This so-called "pool-boiling" can have poor heat transfer performance, can be bulky, can involve a large fluid inventory, and can be difficult to make leak proof at high pressure.

To address the heat transfer performance of an evaporator, it is already known to use so-called "convection-boiling". In order to achieve the convection-boiling effect, the cross section of the evaporator can be reduced. Due to the reduction of the cross section of the evaporator, a mixture of a gas phase and the liquid phase at the exit of the evaporator flows to the condenser. By introducing the vapor mixture to the condenser with the vapor containing liquid droplets the performance of the condenser can be decreased. As such, a positive effect of reduction of the cross section area of the evaporator can be undermined to a large extent by the poor heat transfer performance of the condenser.

SUMMARY

A cooling circuit for cooling at least one heat emitting device is disclosed, said cooling circuit comprising: an evaporator having a housing with at least one wall that is thermally connectable with at least one heat emitting device, and having at least one channel whose cross section is sized such that convection boiling is achievable in at least a portion of said at least one channel during use of the cooling circuit; and at least one separation volume located at a vapor exiting port that is fluidly connected to said at least one channel and to at least one liquid reservoir.

A power module is disclosed comprising: at least one heat emitting device that is thermally connected to at least one cooling circuit which comprises: an evaporator having a housing with at least one wall that is thermally connectable with the at least one heat emitting device, and having at least one channel whose cross section is sized such that convection boiling is achievable in at least a portion of said at least one channel during use of the cooling circuit; and at least one separation volume located at a vapor exiting port that is fluidly connected to said at least one channel and to at least one liquid reservoir.

BRIEF DESCRIPTION OF THE DRAWINGS

The embodiments of the present disclosure are explained in greater detail below using the figures for illustration.

DETAILED DESCRIPTION

Figure 1:
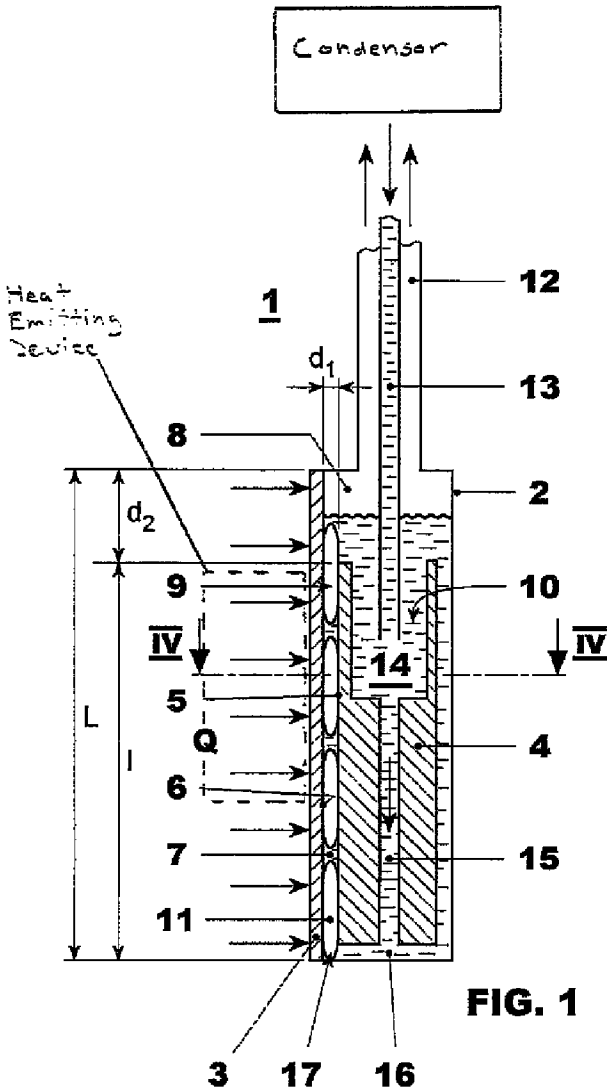
FIG. 1 shows a cross-sectional view of an evaporator according to a first exemplary embodiment of the disclosure.

In exemplary embodiments, an evaporator for a cooling circuit of a power module is disclosed which can, for example, provide an improved heat transfer without affecting the performance of a condenser of the cooling circuit.

The term power module is understood hereinafter as, for example, an assembly having at least one power electronic and/or power electric device, that is thermally connected to at least one cooling circuit. Moreover, the terms power electronic and/or power electric device and heat emitting device are used in an interchangeable manner hereinafter.

As to the cooling circuit, exemplary embodiments include the following characteristics: a cooling circuit for cooling at least one heat emitting device, wherein the cooling circuit includes an evaporator. The evaporator in turn includes a housing having at least one wall that is thermally connectable with (i.e., configured for connection with) the at least one heat emitting device. The evaporator further includes at least one channel whose cross section is sized (e.g., sufficiently small) such that convection boiling is achievable in at least a portion of the at least one channel during use of the cooling circuit. At least one separation volume is located at a vapor exiting port. The at least one separation volume is fluidly connected to the at least one channel and to at least one liquid reservoir.

According to the present disclosure the at least one evaporator of the cooling circuit includes a housing having at least one wall which is, for example, in contact with a heat emitting device. Such a heat emitting device can be, for example, a device for power electronic circuits and the like. It is to be noticed that a limitation regarding the origin of the heat does not affect the principle of the disclosure. Inside the housing of the evaporator one or a plurality of parallel channels leaving a small gap for the vapor-liquid-flow are formed. This confined space in which the boiling takes place enables a convection boiling. The evaporator can further include a separation volume and a liquid reservoir. Depending on the embodiment, one housing may receive more than one heat emitting device.

As it was explained when discussing known convection boiling, the temperature of the liquid flowing through the small gap reaches the boiling temperature. Consequently the gas flow transports also a certain amount of the liquid phase. According to the present disclosure the evaporator also includes at least one separation volume. The at least one separation volume, hereinafter also referred to simply as the separation module for enhanced readability, is located at a vapor exiting port of the channel. Thus, when the cooling circuit is in use, the vapor/liquid mixture is introduced from the at least one channel into the separation volume. So before the flow of vapor exits the evaporator, the phase separation occurs and the liquid phase fraction is not conveyed to the condenser. It is rather dropped back into a liquid reservoir which is furthermore arranged in the evaporator.

An exemplary advantage of the evaporator according to the present disclosure is that a circuit for cooling a heat emitting device using the evaporator can take advantage of both effects. On one hand, heat transfer between the heat emitting device and the liquid inside the evaporator can be improved by providing one or a plurality of parallel channels as a confined space in which a convection boiling takes place. On another hand, an adverse effect of the convection boiling in such a confined gap to the performance of the condenser can be avoided as the condenser of such a cooling circuit is fed with the vapor phase only. The separation of the liquid phase and the vapor phase is conducted inside the separation volume which is arranged subsequent to the channel in the direction of flow. Furthermore as the evaporator also includes a liquid reservoir, it is not necessary to provide a pump or the like in order to supply a sufficient amount of liquid at all the time.

It can be advantageous to constitute one or a plurality of parallel channels by a channel building element inside the housing of the evaporator. The at least one channel building element therefore can include at least one surface at a first side of the channel building element. Depending on the embodiment, the housing may include more than one channel building element. This at least one surface is facing an inside surface of the wall of the evaporator housing. Thus by the channel building element the confined space or channel in which the convection boiling takes place is constituted.

It can be furthermore advantageous to locate the liquid reservoir at a second side of the at least one channel building element other than the first side. With just one additional element, the performance of the overall cooling system can be improved substantially. That is, on one hand, the heat transfer performance of the evaporator can be improved by using convection boiling and on another hand, it is easy to adapt the size of the liquid reservoir to optimize the performance of the evaporator.

So according to a first aspect of the disclosure, it can be an advantage to have a length of at least a portion of that first side of the channel building element in a flow direction, hereinafter also referred to as direction of a direction of flow, in the channel shorter than the inside surface of the wall. This allows positioning the at least one channel building element in such that at a vapor exiting port of the channel a gap is constituted leading directly to the separation volume. In other words, the channel building element is positioned in the flow direction such that at the at least one vapor exiting port of the at least one channel a gap is formed which is larger than a width of the at least one channel, wherein the gap fluidly connects the at least one vapor exiting port with the at least one separation volume.

Such an enlarged gap at the vapor exiting port of the channel can have the advantage that the overall dimensions of the evaporator can be kept low. Such a gap automatically leads to an enlarged distance between the vapor exiting port of the channel and an entrance of a vapor conduit connecting the evaporator with a condenser. This area between the vapor exiting port and the entrance of the vapor conduit constitutes the separation volume that can be built easily by the length shorter than the inside surface of the wall of the evaporator.

For easy manufacturing, it can be an advantage to provide the channel building element as an insert. Such an insert can furthermore have an advantage that the shape of known evaporators may be maintained without the need of developing a new design. Furthermore such an insert to be inserted in an evaporator housing allows a large variety of channel or gap dimensions as well as sizes of the liquid reservoir. Consequently it is easy to adjust the size of the liquid reservoir for providing optimal performance according to the global shape of the evaporator.

Further it can be advantageous to provide at least one spacing means between the inside surface of the wall of the evaporator housing and the at least one surface of the inserted channel building element. In other words, the inside surface can be displaced about a first distance from a first surface of the at least one heat emitting device by means of at least one spacing means. Providing such a spacing means can allow, in a very easy and comfortable way, positioning of the insert correctly inside of the evaporator housing. Depending on the desired requirements and on the manufacturability, the spacing means comprises at least one spacer element that is at least partially integrated in an least one of the wall and the first surface. In addition or alternatively thereto, the spacing means can be formed by at least one separate element.

It can be furthermore advantageous to constitute the liquid reservoir by forming a recess in the channel building element. As such evaporators or thermosyphons have a well-defined orientation during use because of the vapor phase bubbles going up in the liquid phase, it can be assumed that the inside surface of the wall of the housing of the evaporator and the first side of the channel building element are arranged in an at least approximately vertical direction. Consequently the channel extends in a vertical direction with the liquid introduction port formed at the bottom of the evaporator and the vapor exiting port being positioned at the upper end of the channel. The recess can be therefore advantageously a recessed portion arranged at the top side of the channel building element.

Furthermore it can be advantageous to form a conduit inside the channel building element thereby connecting the liquid reservoir with the liquid introduction port or intake of the channel.

In FIG. 1, a first evaporator 1 of an exemplary cooling circuit is shown in a cross-sectional view. The evaporator 1 comprises a housing 2 having at least one wall 3 being in contact with a heat emitting device. For simplification of the drawing, only the at least one wall 3 is shown to have a thickness.

As indicated by the plurality of arrows ending at the outside of the wall 3, heat Q emitted from a device which is, for example, in contact with the wall 3 is introduced to wall 3. In the inside volume of housing 2 an insert 4 is arranged. The insert 4 in the exemplary embodiment is the channel building element. The insert 4 is inserted into the housing 2 by an opening of that housing 2 or during manufacturing of the housing 2.

Insert 4 includes one surface 5 at a first side of the insert 4. This side with the first surface 5 is directed to face an inside surface 6 of wall 3. The first surface 5 and inside surface 6 are spaced from one another in order to form a gap between them. This gap constitutes a channel 7 in which convection boiling due to emitted heat Q takes place. A flow of a mixture of a gas phase and the liquid phase of a coolant flows in a vertical direction upwards. The evaporator 1 is oriented in such a direction that channel 7 is directed in a vertical direction in order to enable the mix of the cooling liquid and the bubbles 11 of the vapor phase to flow in an upward direction. At a vapor exiting port 9 of channel 7 the mixture is introduced into a separation volume 8 which is located so as to be in contact with the vapor exiting port 9.

Due to a first distance $d_1$ in which the first surface 5 of the channel building element 4 and the inside surface 6 is arranged at the end of channel 7, a mixture of the liquid phase and the vapor phase is introduced into the separation volume 8. The length l or longitudinal extension of the first side 5 of the insert 4 is shorter than the total length L of the inside surface of the housing 2. Thus, the second gap with a distance $d_2$ is formed at the upper end of the insert 4. So the separation volume 8 is formed above the vapor exiting port 9. Due to gravity the liquid droplets entrained in the vapor phase separate from the vapor phase after exiting channel 7. The droplets fall back into a reservoir 10 that is arranged at the second side of the insert 4. As can be seen easily in FIG. 1, it can be advantageous to position the liquid reservoir 10 on the top side of insert 4. In the illustrated embodiment, a recess forms the liquid reservoir 10. Within the reservoir 10 the liquid 14 is located and droplets being separated from the vapor phase in the separation volume 8 will join the liquid 14. The vapor phase now free of liquid droplets, is fed via first connecting line 12 to a condenser, not shown. The condensed liquid is transferred back to the evaporator 1 by a second connecting line 13. The second connecting line 13 extends into the recess of the liquid reservoir 10.

In order to supply liquid 14 at an intake 17 of channel 7 it can be desirable to connect reservoir 10 to the intake 17. In the first exemplary embodiment shown in FIG. 1, a conduit 15 is arranged inside the insert 4. Conduit 15 connects the liquid reservoir 10 to another gap 16 located at the bottom side of insert 4 between the housing 2 and insert 4 and extending, for example, to a major part of the width of the evaporator 1.

The first distance $d_1$ can, in exemplary embodiments, be selected small enough in order to enable convection boiling. On another hand, the second distance $d_2$ does not necessarily extend over the whole width of the evaporator 1. For the effect of separation of the droplets from the vapor phase, it is sufficient that there is a separation volume 8 arranged between the vapor exiting port 9 and first connecting line 12. In exemplary embodiments, a velocity of the stream of the mixture of the vapor phase and the liquid phase is low enough to ensure that friction between the stream of the vapor phase and the droplets is reduced so that gravity will force the two phases to separate.

Figure 2:
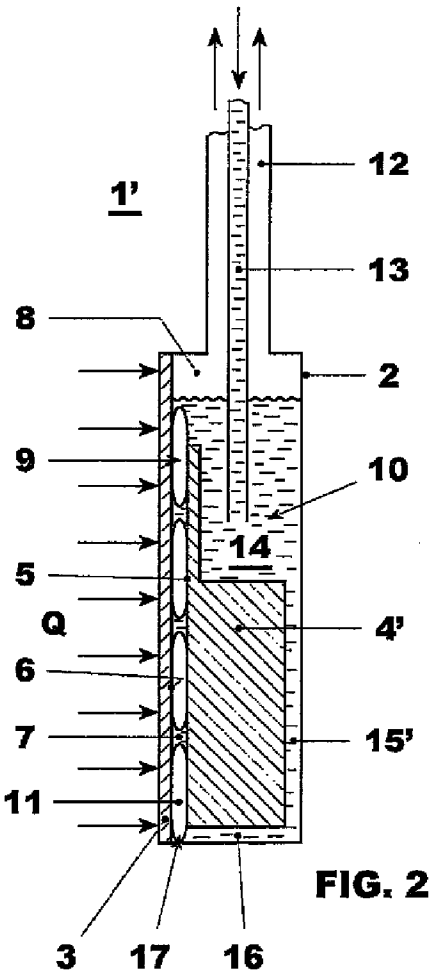
FIG. 2 shows a second exemplary embodiment with a simplified channel building element.

Another example of an evaporator 1' according to the disclosure is shown in FIG. 2. For simplicity, only the differences over FIG. 1 are explained. Similar elements and features as in FIG. 1 are denoted with the same reference numerals and a detailed description thereof will be omitted.

Contrary to the first example, FIG. 2 illustrates an example with a simplified insert 4'. The first side 5 is built in the very same way as in FIG. 1. The recess forming the liquid reservoir 10 is made in a way that in the cross-sectional view shown in FIG. 2 an L-shape of the insert 4' is given. Furthermore conduit 15' is constituted by a second side of insert 4' being opposite to the first surface 5 and facing a second wall of housing 2 at an opposite side with regard to wall 3.

Figure 3:
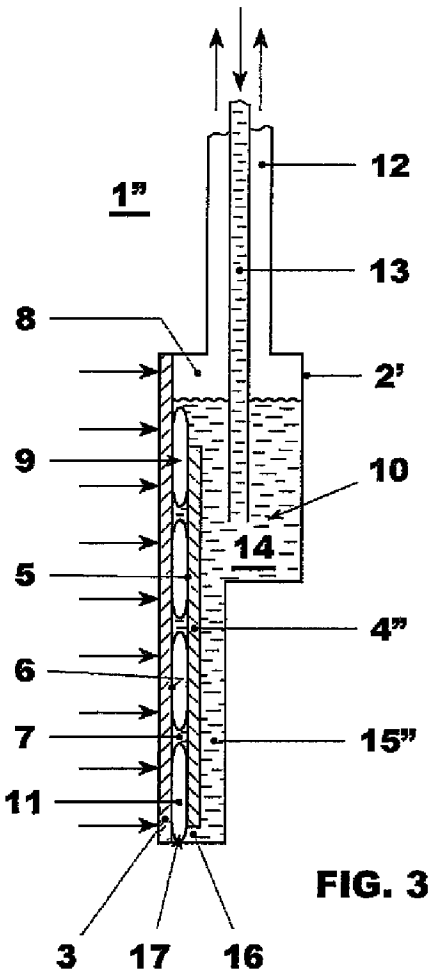
FIG. 3 shows a third exemplary embodiment of the present disclosure with a further simplified channel building element that involves an adaptation of the evaporator housing.

Another example is shown in FIG. 3. The third exemplary embodiment of the evaporator 1" also includes an amended insert 4" that constitutes, in combination with a first wall 3, a channel 7 for forming a confined space in order to enable convection boiling. The separation volume 8 is formed in the very same way in all of the three embodiments. Contrary to embodiments of FIGS. 1 and 2, the liquid reservoir 10 of FIG. 3 is constituted not by a recess of insert 4 or 4' but by a step which is made by a modified housing 2' itself. This modified housing 2' therefore comprises a lower part and an upper part. The lower part has a total inner width so that a plate shaped insert 4" forms channel 7 on its first side and conduit 15" on its second side. The operation of all three embodiments is the same.

All three inserts 4, 4' and 4" can be positioned so as to be in a well-defined distance $d_1$ from first wall 3. For simplification, none of the FIGS. 1 to 3 shows means for positioning the insert 4, 4', 4" inside the housing 2. The first embodiment is shown in different cross-sectional drawings of FIGS. 4*a*) to *c*) with spacers 18.*i* and 19.*i*, which can have various shapes and be supported by different support structures, as positioning means. In a first example, spacers 18.1 to 18.3 are fin-shaped and extend in a longitudinal direction of channel 7. Thereby the first surface of insert 4 is divided into a number of surface parts 5.1 to 5.4. Consequently channel 7 is also divided into subchannels. To accomplish a tight fit, second spacers 19.1 to 19.3 are located at the opposite side of insert 4. These second spacers 19.1 to 19.3 are of the same type as first spacers 18.1 to 18.3. A person skilled in the art will appreciate that the cross-sectional shape of the spacers 18.*i* and 19.*i* as well as the height and width of the illustrated embodiment are not limiting. It is also possible that the spacers are only located at an upper part of insert 4 and a lower part of insert 4 but do not extend over its length l.

Figure 4C:
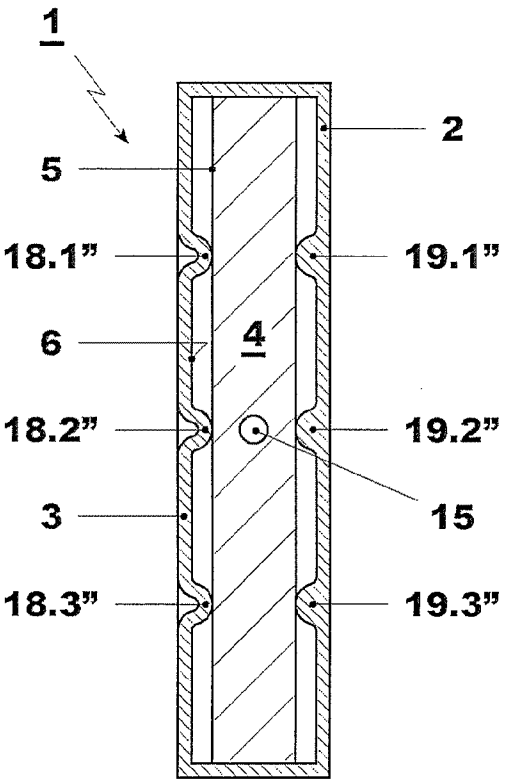
FIGS. 4*a*) to *c*) illustrate different types of spaces for positioning the channel building element inside the evaporator housing.
Figure 4B:
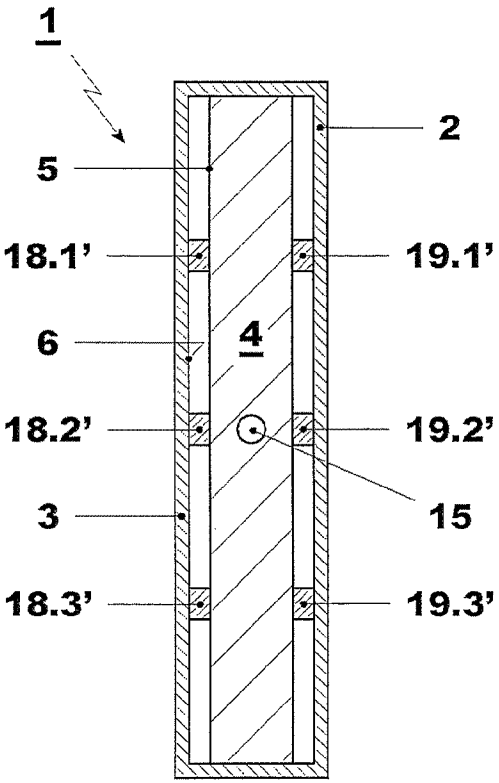
Figure 4A:
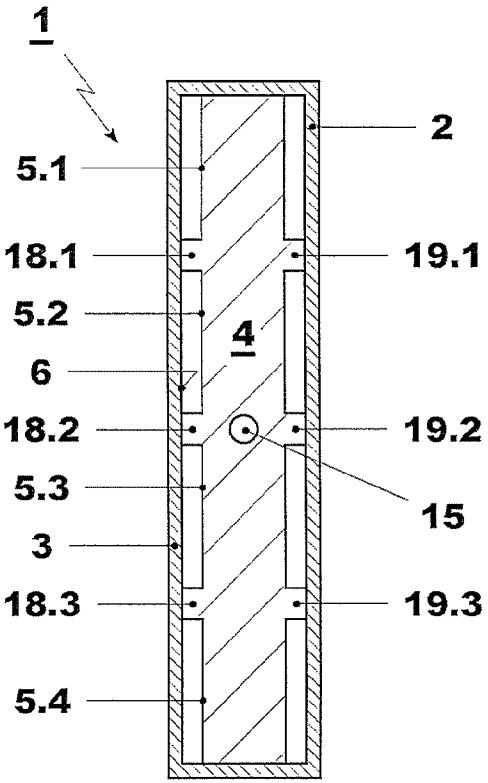

A second example for spacers looking quite similar to the ones of FIG. 4*a*) is shown in FIG. 4*b*). Contrary to spacers 18.1 to 18.3 and 19.1 to 19.3 spacers 18.1' to 18.3' and 19.1' to 19.3' are separate elements from insert 4. These separate elements may be formed as part of housing 2 as it is shown particularly in FIG. 4*c*) or as it is shown in FIG. 4*b*) as parts that are also to be inserted in the gaps formed between insert 4 and housing 2, for example, at both sides.

The spacing means shown in FIG. 4*c* differ to those shown in FIG. 4*a* in that they are not integrated in the insert, but the wall 3 is locally formed such that it features the spacing means. This allows keeping the shape of the at least one insert rather simple without the necessity of complicated features, such as studs or ribs 18.1, 18.2 . . . such as shown in FIG. 4*a*. Returning to the embodiment shown in FIG. 4*c*, the spacing means 18.1", 18.2", 18.3", 19.1", 19.2" and 19.3" are formed by local deformation of the wall 3, for example. Depending on desired requirements, the at least one deformation may be dot-shaped or line-shaped or comprise a mixture thereof, for example.

Figure 5:
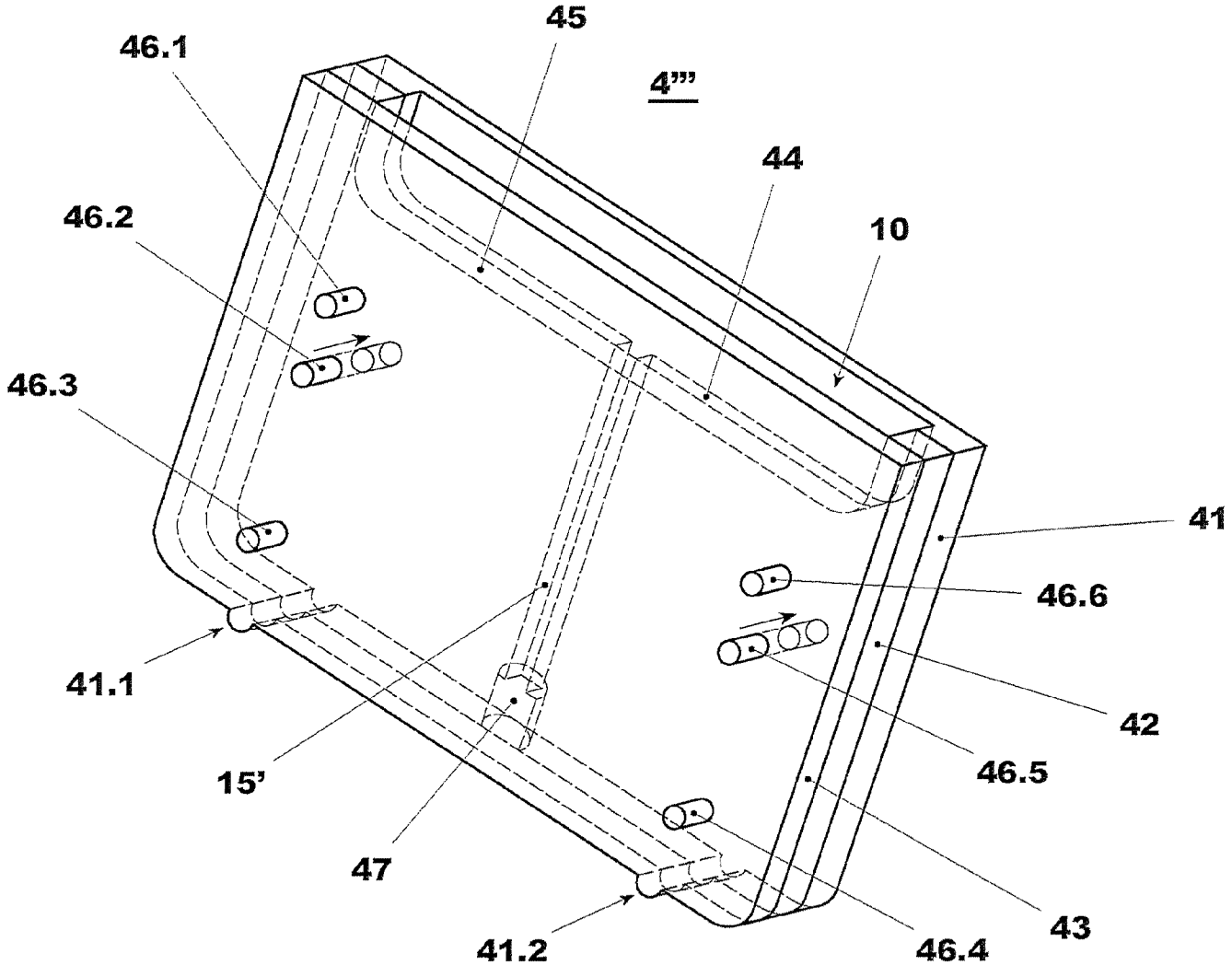
FIG. 5 shows an exemplary embodiment of an insertion type of a channel building element.

In FIG. 5 a three-dimensional perspective view of an insert 4''' in another embodiment is shown. Insert 4''' is comprised of three separate elements 41, 42, 43 that are arranged consecutively. The first of the elements 41 as well as the second element 42 comprise a recessed portion 44 and 45 respectively. In case of the first element 41 the recessed part is provided only in a part of the thickness of first element 41. The third element 43 is a plate-shaped element in order to enclose the recessed portions 44 and 45 thereby constituting a liquid reservoir 10 with an opening only from the top side of insert 4'''. All three of the elements 41 to 43 comprise small steps 41.1 and 41.2 at the bottom edge thereby ensuring that a gap is constituted at the bottom of the evaporator. This gap is connected to liquid reservoir 10 by conduit 15 as shown in FIG. 1. Conduit 15 in the embodiment of FIG. 5 of the insert 4''' is constituted by a groove 15' that is milled into the side of the first element 41 that faces the second element 42.

Building insert 4''' by three consecutive elements 41, 42 and 43 can have an advantage that the conduit 15 may be formed by milling groove 15' which is closed by the second element 42. Groove 15' ends in an enlarged part 47 as an outlet of liquid to the bottom gap of evaporator 1.

Furthermore it is shown that a number of spacer elements 46.1 to 46.6 is provided in order to keep a definite distance between the inside surface of housing 2 and insert 4'''. For intelligibility of the drawings the spacers shown are limited to the ones that are inserted into the third element 43. As it can easily be understood the first element 41 of insert 4''' also comprises a number of additional spacers in order to define the first distance $d_1$ between the first surface of insert 4''' and the inside surface of wall 3.

The disclosure is not limited to any of the embodiments shown in the drawings and explained in the description. Individual features of different embodiments may be combined in any way.

It will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

What is claimed is:

1. Cooling circuit for cooling at least one heat emitting device, said cooling circuit comprising:

an evaporator having a housing with at least one wall that is thermally connectable with the at least one heat emitting device such that heat from the at least one heat emitting device is introducible to said at least one wall from outside the housing, the evaporator having at least one channel whose cross section is sized such that convection boiling is achievable in at least a portion of said at least one channel during use of the cooling circuit;

at least one separation volume located at a vapor exiting port that is fluidly connected to said at least one channel and to at least one liquid reservoir;

wherein the at least one channel includes at least one channel building element arranged inside the housing, said at least one channel building element comprising at least one surface at a first side of said at least one channel building element facing an inside surface of said wall and constituting the at least one channel with said wall and the at least one channel building element is an insert.

2. Cooling circuit according to claim 1, wherein the at least one liquid reservoir is arranged at a second side of said at least one channel building element other than said first side.

3. Cooling circuit according to claim 1, wherein a length (l) of at least a portion of said first side of said channel building element extends in a flow direction in said at least one channel and is shorter than said inside surface of said wall and wherein said channel building element is positioned in said flow direction such that at said at least one vapor exiting port of said at least one channel, a gap ($d_2$) is formed which is larger than a width ($d_1$) of said at least one channel, wherein said gap ($d_2$) fluidly connects said at least one vapor exiting port with said at least one separation volume.

4. Cooling circuit according to claim 1, wherein the inside surface is displaced about a first distance ($d_1$) from a first surface of the at least one heat emitting device by means of at least one spacing means.

5. Cooling circuit according to claim 4, wherein the spacing means comprises:

at least one spacer element that is at least partially integrated in at least one of the wall of the housing and the first surface of the heat emitting device.

6. Cooling circuit according to claim 2, wherein said at least one liquid reservoir is formed by at least one recess in said channel building element.

7. Cooling circuit according to claim 1, comprising:

at least one conduit formed in said at least one channel building element, said at least one conduit extending from said at least one liquid reservoir to an intake of said at least one channel.

8. Cooling circuit according to claim 1, comprising:

at least one condenser that is fluidly connected to the evaporator by at least one first connecting line such that vapor is feedable from the evaporator to the condenser; and a second connecting line, by which condensed liquid is transferable back from the condenser to the evaporator during use of the cooling circuit.

9. Cooling circuit according to claim 8, wherein the at least one first connecting line ends within the evaporator within the at least one separation volume; and/or the second connecting line ends within the evaporator within the liquid reservoir.

10. Power module comprising:

at least one heat emitting device that is thermally connected to at least one cooling circuit, the cooling circuit comprising:

an evaporator having a housing with at least one wall that is thermally connectable with the at least one heat emitting device such that heat from the at least one heat emitting device is introducible to the at least one wall from outside of the housing, the evaporator having at least one channel whose cross section is sized such that convection boiling is achievable in at least a portion of said at least one channel during use of the cooling circuit; and at least one separation volume located at a vapor exiting port that is fluidly connected to said at least one channel and to at least one liquid reservoir;

wherein the at least one channel includes at least one channel building element arranged inside the housing, said at least one channel building element comprising at least one surface at a first side of said at least one channel building element facing an inside surface of said wall and constituting the at least one channel with said wall and the at least one channel building element is an insert.

11. Power module according to claim 10, wherein the at least one heat emitting device comprises:

at least one of a power electronic and a power electric device.

12. Cooling circuit according to claim 2, wherein a length (l) of at least a portion of said first side of said channel building element extends in a flow direction in said at least one channel and is shorter than said inside surface of said wall and wherein said channel building element is positioned in said flow direction such that at said at least one vapor exiting port of said at least one channel, a gap ($d_2$) is formed which is larger than a width ($d_1$) of said at least one channel, wherein said gap ($d_2$) fluidly connects said at least one vapor exiting port with said at least one separation volume.

13. Cooling circuit according to claim 2, wherein the inside surface is displaced about a first distance ($d_1$) from a first surface of the at least one heat emitting device by means of at least one spacing means.

14. Cooling circuit according to claim 13, comprising:

at least one conduit is formed in said at least one channel building element, said at least one conduit extending from said at least one liquid reservoir to an intake of said at least one channel.

15. Cooling circuit according to claim 14, comprising:

at least one condenser that is fluidly connected to the evaporator by at least one first connecting line such that vapor is feedable from the evaporator to the condenser; and a second connecting line, by which condensed liquid is transferable back from the condenser to the evaporator during use of the cooling circuit.

16. Cooling circuit comprising:

an evaporator having a housing with at least one wall that is thermally connectable with at least one heat emitting device such that heat from the at least one heating emitting device is introducible to said at least one wall from outside of the housing;

the evaporator having at least one channel within the evaporator with a cross section size selected for convection boiling in at least a portion of the channel during operation; and a separation volume, located at a vapor exiting port and fluidly connected to said channel and to a liquid reservoir;

wherein the at least one channel includes at least one channel building element arranged inside the housing, said at least one channel building element comprising at least one surface at a first side of said at least one channel building element facing an inside surface of said wall and constituting the at least one channel with said wall and the at least one channel building element is an insert.

17. Cooling circuit according to claim 16, wherein a length (l) of at least a portion of a first side of said channel extends in a flow direction in said channel and is shorter than an inside surface of said wall; and wherein at said vapor exiting port of said channel, a gap ($d_2$) is formed which is larger than a width ($d_1$) of said channel, wherein said gap ($d_2$) fluidly connects said vapor exiting port with said separation volume.

* * * * *